US006672031B2

(12) United States Patent
Huang

(10) Patent No.: US 6,672,031 B2
(45) Date of Patent: Jan. 6, 2004

(54) ENVIRONMENT PROTECTIVE LINER PLANK STRUCTURE

(76) Inventor: Tse-Wei Huang, No. 11, Lane 88, Goh-Chien Li, Lu Kan Chen, Changhua Hsien (TW)

( * ) Notice: Subject to any disclaimer, the term of this patent is extended or adjusted under 35 U.S.C. 154(b) by 82 days.

(21) Appl. No.: 10/044,942

(22) Filed: Jan. 15, 2002

(65) Prior Publication Data

US 2003/0131540 A1 Jul. 17, 2003

(51) Int. Cl.[7] ..... E04C 2/00

(52) U.S. Cl. ..... 52/782.1; 52/783.1; 52/796.1; 52/DIG. 9; 264/113; 264/319; 264/239; 528/292.4; 528/326; 528/221; 528/411.1; 156/62.2

(58) Field of Search ..... 52/783.1, 602, 52/480, DIG. 9, 782.1, 796.1, 79.1; 405/203; 264/113, 118, 109, 122, 211, 229, 319, 231, 271.1, 239; 428/326, 221, 402, 407, 526, 528, 529, 535, 292.4, 411.1; 156/62.2

(56) References Cited

U.S. PATENT DOCUMENTS 3,995,003 A * 11/1976 Potter et al. ..... 264/122
4,058,580 A * 11/1977 Flanders ..... 264/13
4,108,377 A * 8/1978 Potter ..... 238/91
4,127,636 A * 11/1978 Flanders ..... 264/113
4,486,557 A * 12/1984 Gaul et al. ..... 523/446
4,716,062 A * 12/1987 Klein ..... 428/36
4,748,777 A * 6/1988 Glassco et al. ..... 52/82
4,879,850 A * 11/1989 Glassco et al. ..... 52/82
6,164,034 A * 12/2000 Roetheli et al. ..... 52/560
6,329,565 B1 * 12/2001 Dutkiewicz et al. ..... 604/378

* cited by examiner

*Primary Examiner*—Jeanette Chapman
(74) *Attorney, Agent, or Firm*—Bacon & Thomas, PLLC

(57) ABSTRACT

Environment protective liner plank structure having several legs and a panel. Each leg is composed of multiple layers of rice grasses (or wheat stems) which evenly overlap each other in the same direction. A layer of adhesive is sprayed between each two layers of rice grasses (or wheat stems). When each layer of rice grasses (or wheat stems) is evenly overlaid on a lower layer of rice grasses (or wheat stems), a male mold is used to compress the rice grasses (or wheat stems) into a compact state. The lowermost layer of rice grasses (or wheat stems) of the panel is evenly overlaid on the adhesive on the uppermost layer of rice grasses (or wheat stems) of the leg. A plane board mold is used to compress the rice grasses (or wheat stems) into a compact state. A layer of adhesive is sprayed over the lowermost layer of rice grasses (or wheat stems) of the panel and then an upper layer of rice grasses (or wheat stems) are overlaid on the lowermost layer of rice grasses (or wheat stems). Then, the plane board mold is used to compress the layer of rice grasses (or wheat stems). Such procedure is repeated until the panel of the rice grasses (or wheat stems) has a certain thickness.

6 Claims, 5 Drawing Sheets

ENVIRONMENT PROTECTIVE LINER PLANK STRUCTURE

BACKGROUND OF THE INVENTION

The present invention is related to an environment protective liner plank structure made of waste rice grasses (or wheat stems) which are high pressure compacted. Such a liner plank is manufactured at low cost without ruining natural trees and causing environmental pollution.

FIG. 1 shows a conventional wooden liner plank 10 formed with several legs 12 and slats 11 overlaid thereon. The slats 11 are fixed with the legs 12 by nails.

Such a liner plank has some shortcomings as follows:

1. The liner plank is made from natural trees so that the forest and maintenance of water and soil may be ruined.
2. The trunk of a tree is milled into wooden boards. The slats 11 and legs 12 are made of the wooden boards. The slats 11 and legs 12 are nailed with nails 13 one by one. All these procedures are complicated and troublesome.
3. In case the slats 11 bear a heavy load of a cargo and are damaged, the slats 11 may thrust into the cargo.
4. The liner plank is heavy so that it is laborious to use and move the liner plank and a forklift must be used to move the liner plank. Therefore, it is quite inconvenient to use such liner plank.
5. It is hard and expensive to repair such a liner plank.

FIG. 2 shows another type of conventional solid liner plank 20 which is integrally made of plastic material. This liner plank 20 has a panel 21 and several legs 22.

The above liner plank also has some shortcomings as follows:

1. The plastic liner plank has a large volume so that a large mold is necessary for integrally molding the liner plank. Moreover, it is time-consuming to mold the plastic liner plank so that it is impossible to mass-produce the plastic liner plank.
2. The plastic liner plank has a weight slightly lighter than the wooden liner plank 10. However, it is still heavy and cannot be conveniently used.
3. The manufacturing cost for the plastic liner plank is high. Once the plastic liner plank is damaged, it will be impossible to repair the plastic liner plank and the plastic liner plank must be discarded. This leads to waste.
4. The discarded plastic liner plank will result in environmental pollution.

FIG. 3 shows still another type of conventional liner plank 30 which is made of paper material. Reinforcing material is placed between the layers of paper material to form a panel 31 and legs 33. The panel 31 is adhered to the legs 33 to form the paper-made liner plank.

The above liner plank still has some shortcomings as follows:

1. The paper-made liner plank is also made from natural trees so that the forest and maintenance of water and soil may be ruined.
2. It is necessary to add a special reinforcing material 33 into the paper material to enhance the strength of the liner plank. Such a procedure is complicated and troublesome.
3. The paper-made liner plank may be subject to the thrust of sharp objects and is very likely to be damaged.

SUMMARY OF THE INVENTION

It is therefore a primary object of the present invention to provide an environment protective liner plank structure made of waste rice grasses (or wheat stems ) which are high pressure compacted. Such a liner plank is manufactured without ruining natural trees and causing environmental pollution.

It is a further object of the present invention to provide the above environment protective liner plank structure made of waste rice grasses (or wheat stems) at low cost.

It is still a further object of the present invention to provide the above environment protective liner plank structure made of rice grasses (or wheat stems) which is light weight and water-impermeable. The surface of the liner plank is treated with an adhesive so that the liner lank can be conveniently and durably used.

It is still a further object of the present invent ion to provide the above environment protective liner plank structure made of rice grasses (or wheat stems) which are easily compressed so that the liner plank can be mass-produced.

It is still a further object of the present invention to provide the above environment protective liner plank structure made of rice grasses (or wheat stems) which are high pressure compacted. The liner plank is not susceptible to being cut or damaged by external objects and the structural strength of the liner plank is not easily weakened.

The present invention can be best understood through the following description and accompanying drawings wherein:

DETAILED DESCRIPTION OF THE PREFERRED EMBODIMENTS

Figure 1:
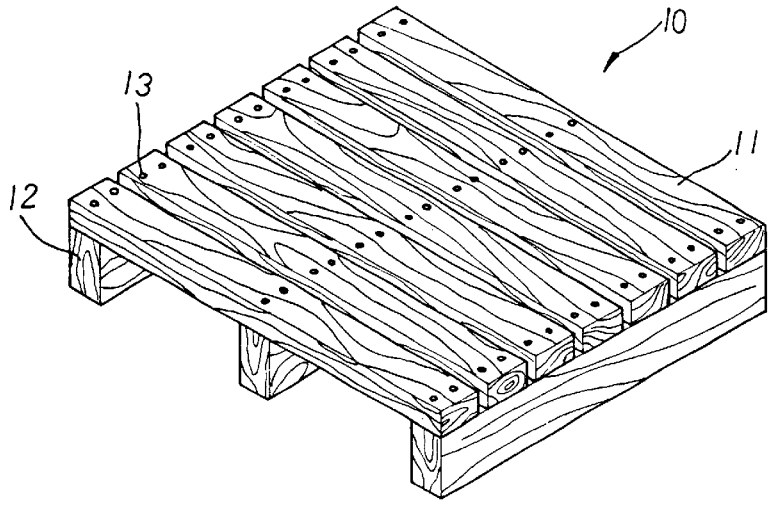
PRIOR ART FIG.1
FIG. 1 is a perspective assembled view of a conventional liner plank.
Figure 2:
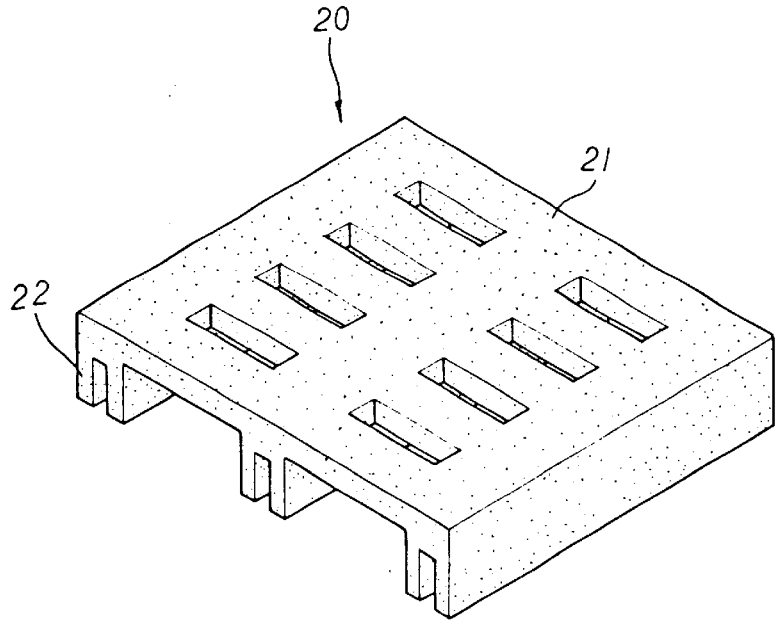
PRIOR ART FIG.2
FIG. 2 is a perspective view of another type of conventional liner plank.
Figure 3:
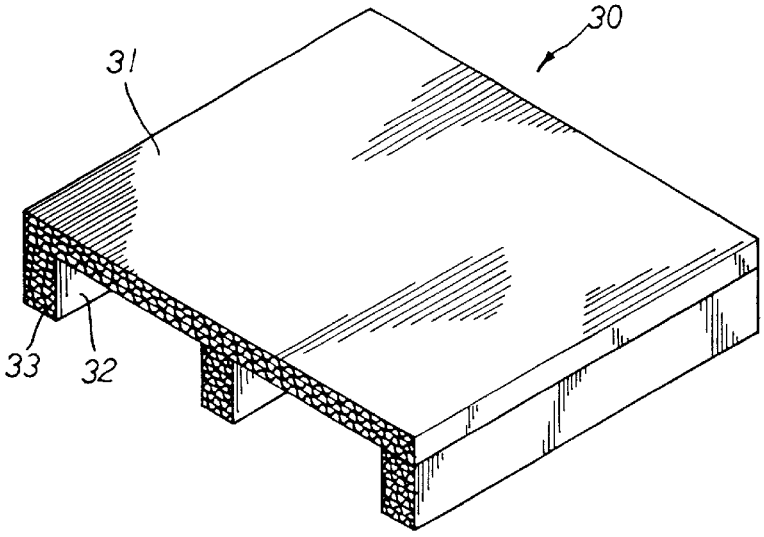
FIG. 3 is a perspective assembled view of still another conventional liner plank.
Figure 5:
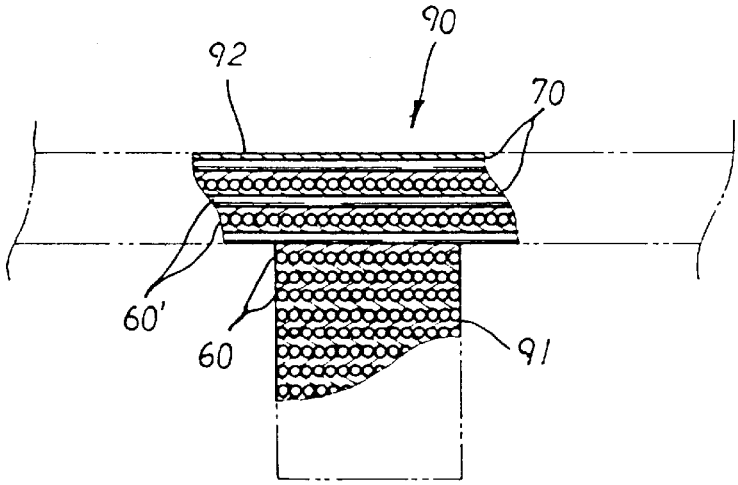
FIG. 5 is an enlarged sectional assembled view of the present invention.
Figure 4:
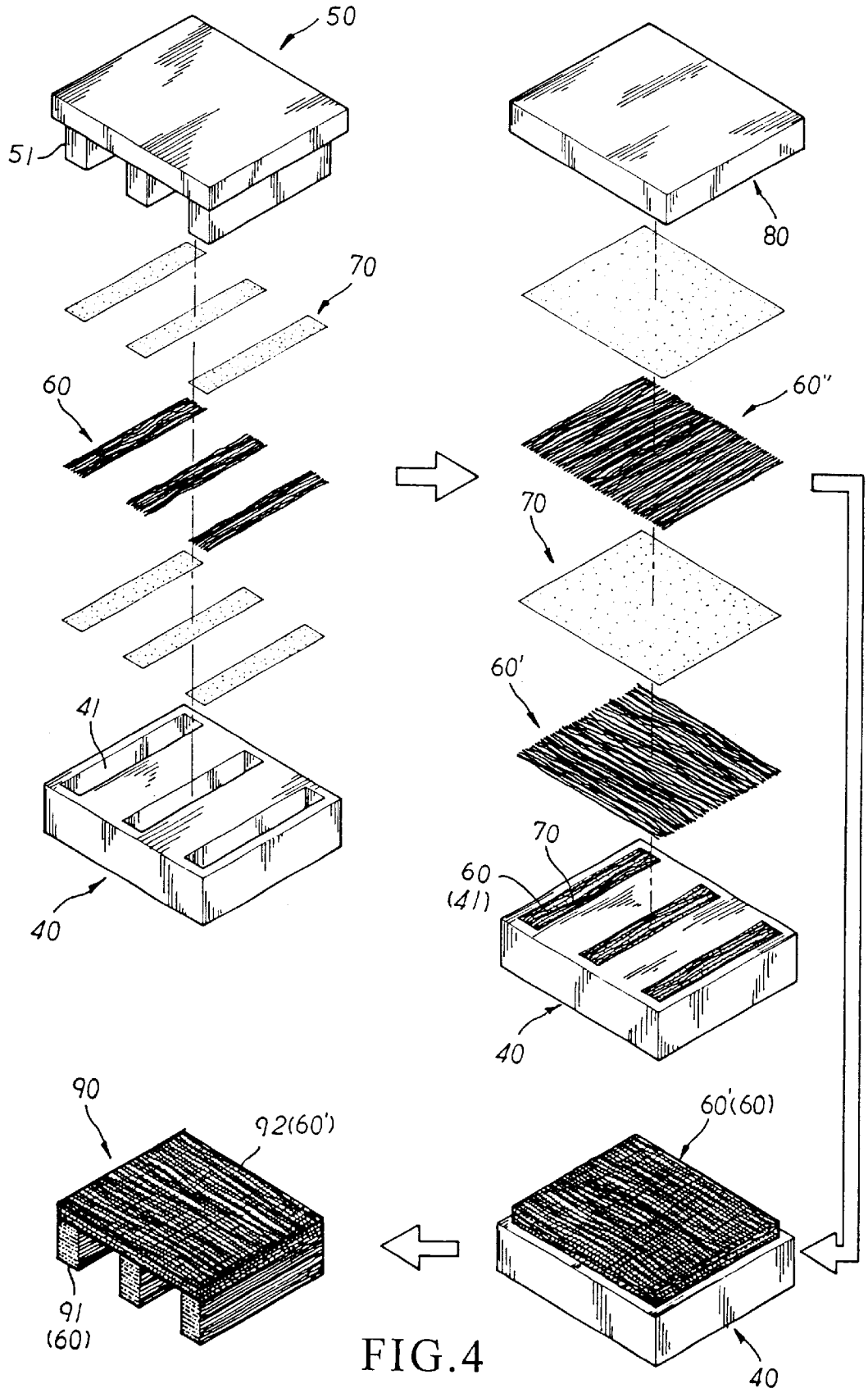
FIG. 4 is a manufacturing flow chart of the present invention.

Please refer to FIG. 4 which shows the manufacturing flow chart of the present invention. Several groups of rice grasses (or wheat stems) 60 with substantially equal length are placed into the cavities 41 of a female mold 40. The rice grasses (or wheat stems) 60 are compressed by the projecting leg 51 of a male mold 50. Then, an adhesive 70 is sprayed onto the surface of the rice grasses (or wheat stems) 60 in the cavities 41. Such procedure is repeated to make the rice grasses (or wheat stems) 60 have a height slightly higher than the surface of the female mold 40 and serve as legs of the liner plank. Then, the adhesive 70 is sprayed over the upper surface of the female mold 40 and then a layer of rice grasses (or wheat stems) 60' are overlaid on the upper surface of the female mold 40 in the same direction as the rice grasses (or wheat stems) 60 in the cavities 41. Then, the adhesive 70 is sprayed over the upper surface and another layer of rice grasses (or wheat stems ) 60" are overlaid on the first layer of rice grasses (or wheat stems) 60 in a different direction. A plane board mold 80 is used to downward press the rice grasses (or wheat stems) 60". The procedure is repeated until the rice grasses (or wheat stems) 60' have a certain thickness and are formed as a panel. Thereafter, the adhesive 70 is evenly sprayed over the uppermost surface of the panel-shaped rice grasses (or wheat stems) 60' and then the female mold 40 is taken off. At this time, an environment protective liner plank having legs 91 and panel 92 is achieved (as shown in FIG. 5).

Figure 6:
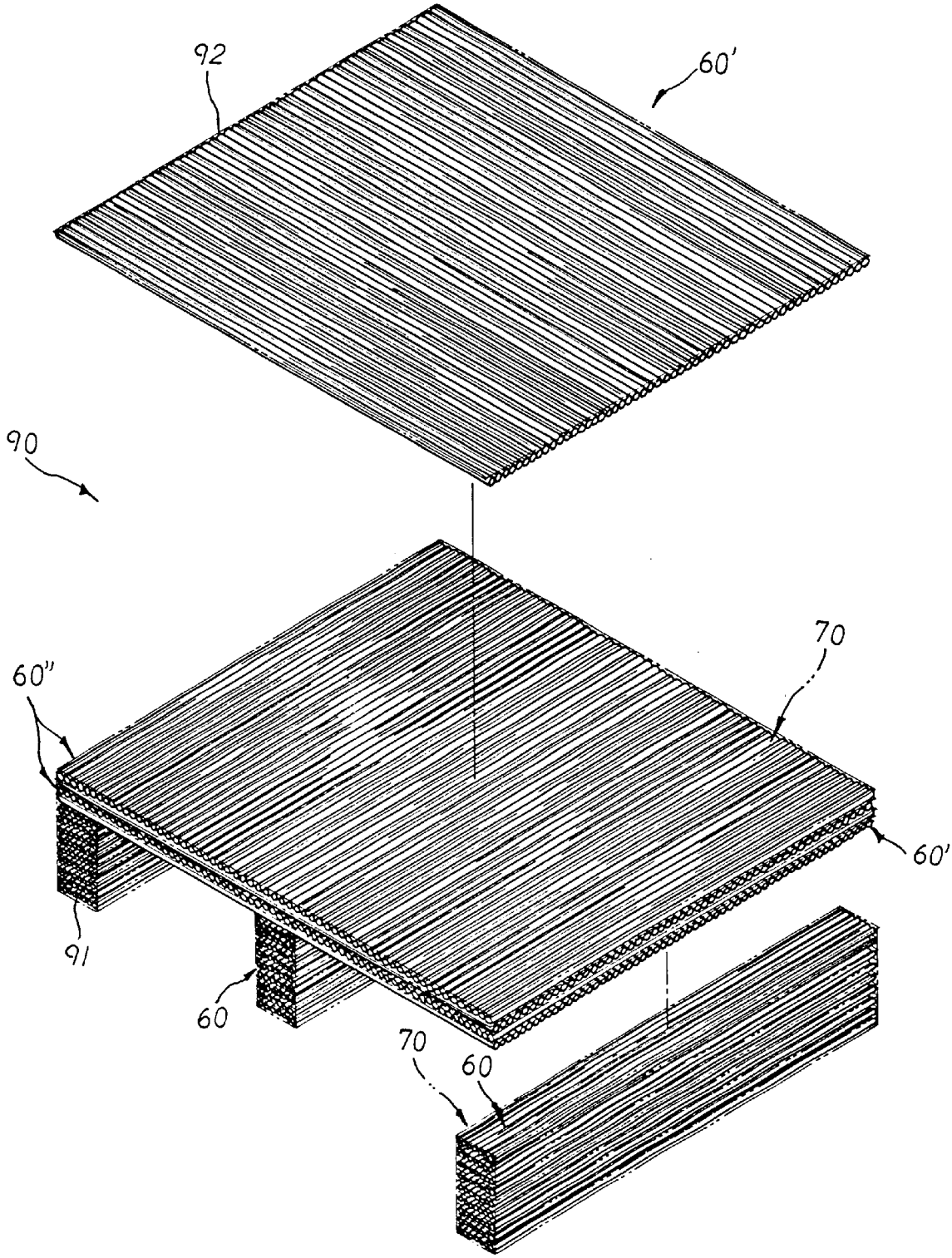
FIG. 6 is a perspective exploded view of the present invention.

FIG. 6 is a perspective exploded view of the present invention which includes several legs 91 and a panel 92. Each leg 91 is composed of multiple layers of rice grasses (or wheat stems) 60 which evenly overlap each other in the same direction. A layer of adhesive 70 is sprayed between each two layers of rice grasses (or wheat stems) 60. When each layer of rice grasses (or wheat stems) 60 is evenly overlaid on a tower layer of rice grasses (or wheat stems) 60, the male mold 50 is used to compress the rice grasses (or wheat stems) 60 into a compact state. The lowermost layer of rice grasses (or wheat stems) 60 of the panel 92 are evenly overlaid on the adhesive 70 on the uppermost layer of rice grasses (or wheat stems) 60 of the leg 91. A plane board mold 80 is used to compress the rice grasses (or wheat stems) 60 into a compact state. A layer of adhesive 70 is sprayed over the lowermost layer of rice grasses (or wheat stems) 60' of the panel 92 and then an upper layer of rice grasses (or wheat stems) 60" are overlaid on the lowermost layer of rice grasses (or wheat stems) 60'. Then, the plane board mold 80 is used to compress the layer of rice grasses (or wheat stems) 60". Such procedure is repeated until the panel 92 of the rice grasses (or wheat stems) 60 has a certain thickness.

Figure 7:
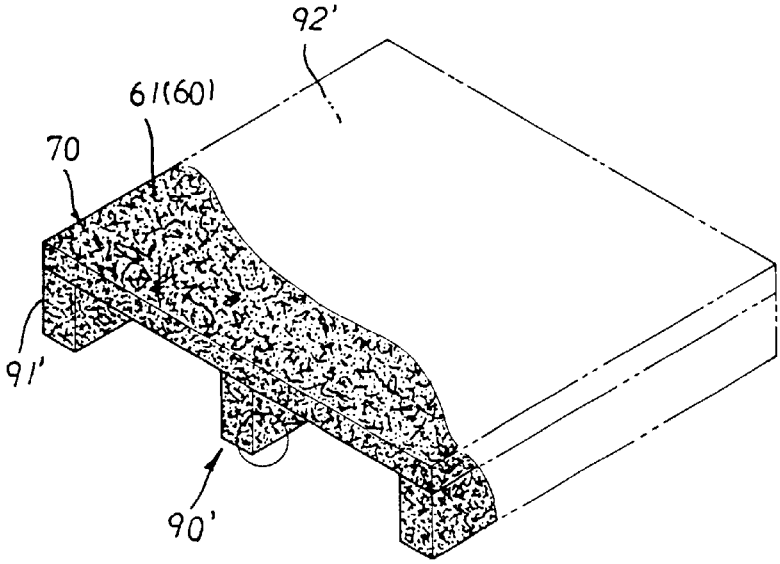
FIG. 7 is a perspective view of another embodiment of the present invention.
Figure 8:
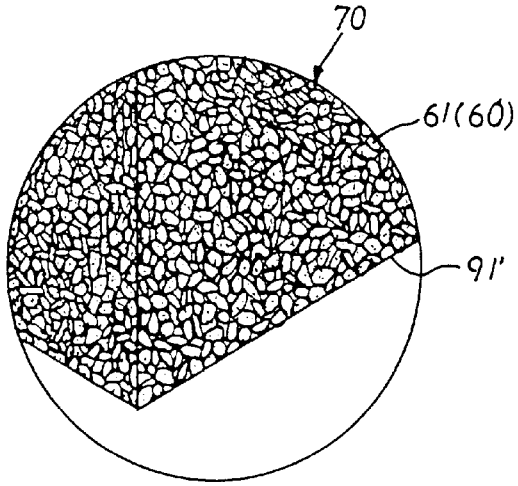
FIG. 8 is an enlarged view of a part of the other embodiment of FIG. 7 of the present invention.

FIGS. 7 and 8 show another embodiment of the present invention, in which several groups of rice grasses (or wheat stems) 60 are first chopped into chips of rice grasses (or wheat stems) 60. Then, the adhesive 70 is mixed with the chips of rice grasses (or wheat stems) 60 and stirred into a thin state. Then a certain amount of mixture is poured into the cavities 41 of the female mold 40. The projecting legs 51 of the male mold 50 are used to compress the mixture. Such procedure is repeated to form legs of the liner plank. Then, a certain amount of mixture is poured onto the upper surface of the legs and a plane board mold 80 is used to downward press the mixture. Such procedure is repeated until a panel of a certain thickness is formed. The adhesive 70 is then evenly sprayed over the upper surface of the panel and then the female mold 40 is taken off. At this time, an environment protective liner plank 90' made of chips of rice grasses (or wheat stems) 60 and having legs 91' and panel 92' is achieved.

The above embodiments are only used to illustrate the present invention, not intended to limit the scope thereof. Many modifications of the above embodiments can be made without departing from the spirit of the present invention.

What is claimed is:

1. An environment protective liner plank structure having several legs and a panel, said environment protective liner plank structure being characterized in that each leg is composed of multiple layers of rice grasses or wheat stems compressed into a compact state by a male mold and which evenly overlap each other in the same direction with a layer of adhesive between each two layers of rice grasses or wheat stems, the lower most layer of rice grasses or heat stems of the panel being evenly overlaid on the adhesive of the upper most layer of rice grasses or wheat stems of the leg, the panel comprising compressed rice grasses or wheat stems in a compact state and having a layer of adhesive over the lower most layer of rice grasses or wheat stems of the panel and having an upper layer of rice grasses or wheat stems being overlaid on the lower most layer of rice grasses or wheat stems.

2. The environment protective liner plank structure as claimed in claim 1, wherein the layers of rice grasses or wheat stems of the legs are oriented in the same direction.

3. An environment protective liner plank structure as claimed in claim 1, wherein the direction of each layer of rice grasses or wheat stems of the panel intersects the direction of the adjacent layer of rice grasses or wheat stems to reinforce the panel.

4. An environment protective liner plank structure as claimed in claim 1, 2, or 3, wherein a layer of adhesive is between each two adjacent layers of rice grasses or wheat stems of the legs and panel.

5. A method of producing an environmental protective liner plank structure wherein several groups of rice grasses or wheat stems are first chopped into chips of rice grasses or wheat stems, then an adhesive is mixed with the chips of rice grasses or wheat stems and stirred into a thin state, then a certain amount of mixture is poured into the cavities of a female mold, the projecting legs of a male mold being used to compress the mixture in the cavities of the female mold, and such procedure is repeated to form legs of the liner plank, then, a certain amount of mixture is poured onto the upper surface of the legs and a plane board mold is used to downward press the mixture, such procedure being repeated until a panel of a certain thickness is formed, the adhesive being then evenly sprayed over the upper surface of the panel and then the female mold being taken off so as to achieve an environment protective liner plank made of chips of rice grasses or wheat stems and having legs and a panel.

6. The environment protective plank structure made by the process of claim 5.

* * * * *